United States Patent [19]

Tassoney

[11] 4,379,591

[45] Apr. 12, 1983

[54] TWO-STAGE OIL SHALE RETORTING PROCESS AND DISPOSAL OF SPENT OIL SHALE

[75] Inventor: Joseph P. Tassoney, Diamond Bar, Calif.

[73] Assignee: Occidental Oil Shale, Inc., Grand Junction, Colo.

[21] Appl. No.: 179,988

[22] Filed: Aug. 21, 1980

Related U.S. Application Data

[63] Continuation-in-part of Ser. No. 752,990, Dec. 21, 1976, abandoned, which is a continuation-in-part of Ser. No. 658,811, Feb. 17, 1976, abandoned, which is a continuation of Ser. No. 496,970, Aug. 13, 1974, abandoned.

[51] Int. Cl.[3] ..... E21B 43/26

[52] U.S. Cl. ..... 299/2; 299/11; 405/267

[58] Field of Search ..... 299/2, 5, 11, 13, 18, 299/19; 405/267

[56] References Cited

U.S. PATENT DOCUMENTS

| | | | |
|---|---|---|---|
| 3,084,919 | 4/1963 | Slater | 166/302 |
| 3,459,003 | 8/1969 | O'Neal | 299/11 X |
| 3,617,471 | 11/1971 | Schlinger | 208/11 |
| 3,620,301 | 11/1971 | Nichols | 166/251 |
| 3,661,423 | 5/1976 | Garrett | 299/2 |
| 4,014,575 | 3/1977 | French | 166/267 X |
| 4,120,355 | 10/1978 | Krepper et al. | 299/2 |
| 4,131,416 | 12/1978 | Watson et al. | 299/2 |
| 4,178,039 | 12/1979 | Burton | 299/2 |
| 4,231,617 | 11/1980 | Larson | 299/2 |
| 4,285,547 | 8/1981 | Weichman | 299/2 |

*Primary Examiner*—William F. Pate, III

*Attorney, Agent, or Firm*—Christie, Parker & Hale

[57] ABSTRACT

Formation is excavated from an in situ oil shale retort site for forming at least one void within the retort site, leaving at least one remaining zone of unfragmented formation within the retort site adjacent such a void. The remaining zone is explosively expanded toward such a void for forming a fragmented permeable mass of formation particles containing oil shale in an in situ oil shale retort. Oil shale in the in situ retort is retorted to produce liquid and gaseous products, leaving a mass of spent oil shale particles in the in situ retort. Oil shale particles excavated from the in situ retort site are separately retorted, such as in a surface retorting operation, producing liquid and gaseous products and spent surface retorted oil shale particles. The spent surface retorted particles are disposed of by forming an aqueous slurry of the particles, and pumping the slurry into a spent in situ retort. In one embodiment, the aqueous slurry is introduced into a hot lower portion of the spent retort where contact with hot spent oil shale particles generates steam which, in turn, is withdrawn from the spent retort in usable form. In another embodiment, water from the aqueous slurry introduced into a spent in situ retort collects at a level within the retort. The water can be recovered by drilling a drainage hole upwardly from a lower level drift into the level within the spent retort where the water collects and draining the water through the drainage hole to the lower level drift for recovery.

7 Claims, 3 Drawing Figures

TWO-STAGE OIL SHALE RETORTING PROCESS AND DISPOSAL OF SPENT OIL SHALE

CROSS-REFERENCES

This application is a continuation-in-part of application Ser. No. 752,990, filed Dec. 21, 1976 abandoned which is a continuation-in-part of application Ser. No. 658,811, filed Feb. 17, 1976, abandoned; which is a continuation of application Ser. No. 496,970, filed Aug. 13, 1974, abandoned. These applications are incorporated herein by this reference.

BACKGROUND OF THE INVENTION

1. Field of the Invention

This invention relates to a process for recovering shale oil from subterranean formations containing oil shale; and more particularly, to a process involving in situ oil shale retorting, above ground oil shale retorting, and disposal of spent oil shale.

2. Description of the Prior Art

The presence of large deposits of oil shale in the semi-arid high plateau region of the Western United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale at the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; 4,043,598; and 4,192,554, which are incorporated herein by this reference. These patents describe in situ recovery of liquid and gaseous hydrocarbon materials from a subterranean formation containing oil shale, wherein such formation is explosively expanded for forming a fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous material to produce heat, combustion gas, and combusted oil shale. By continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

The disposal of spent oil shale from above ground processing presents severe environmental problems. It has been calculated that the waste from a one million barrel per day surface retorting operation would be approximately 1.3 million tons of spent oil shale per day, or approximately ½ billion tons of spent oil shale per year. This estimate of 1.3 million tons of spent oil shale per day is for production of oil which would be approximately 5% of our national requirement by the year 2000.

Spent oil shale is alkaline, toxic to vegetation, and unattractive when dumped above ground. It is therefore desirable to reduce the waste from above ground oil shale retorting and to minimize the leaching of toxic chemicals from spent oil shale.

There is a need to provide an economical system for disposing of large volumes of spent oil shale located above ground. A substantial amount of energy can be consumed in disposing of such large volumes of spent shale, and it would be desirable to provide a disposal system that recovers at least a portion of this energy in usable form.

SUMMARY OF THE INVENTION

According to one embodiment of the present invention, liquid and gaseous products of retorting are recovered from a subterranean formation containing oil shale by initially excavating a void within the boundaries of an in situ oil shale retort site, leaving a remaining portion of formation within the boundaries of the retort site adjacent such a void. The remaining portion of formation is explosively expanded toward such a void for forming an in situ oil shale retort containing a fragmented permeable mass of formation particles containing oil shale. The fragmented mass is retorted for producing liquid and gaseous products, leaving a spent in situ retort containing a mass of in situ retorted oil shale particles, which includes heated in situ retorted particles in at least a hot lower portion of the spent in situ retort. Oil shale is separately retorted to produce liquid and gaseous products and separately retorted oil shale particles. The separately retorted oil shale can be from oil shale excavated when forming a void in the in situ oil shale retort site, and the oil shale can be separately retorted by surface retorting techniques. An aqueous slurry is formed from the separately retorted oil shale particles, and the aqueous slurry is introduced into the spent in situ oil shale retort for disposing of the spent shale that has been separately retorted. At least a portion of the slurry is introduced into the hot lower portion of the retort for transferring heat to the aqueous slurry from the heated lower portion of the in situ retorted oil shale particles. This generates steam in the spent in situ oil shale retort, and the steam can be withdrawn from the spent in situ oil shale retort in usable form.

According to another embodiment of the invention, such an aqueous slurry of spent oil shale particles can be introduced into a spent in situ oil shale retort, causing water from the slurry to collect at a level within the spent in situ retort above a mass of particles containing at least a portion of the spent particles from the slurry introduced into the spent in situ retort. The water collected in the spent in situ retort can be drained into a lower level drift adjacent a lower boundary of the in situ oil shale retort, and the water can be withdrawn from the lower level drift for further use.

The invention has the advantage that high shale oil yields are obtained, while most of the solid waste remains in or is returned to the subterranean formation, and while steam and/or water can be recovered and put to further advantageous uses.

DRAWINGS

These and other aspects of the invention will be more fully understood by referring to the following detailed description and the accompanying drawings in which.

DETAILED DESCRIPTION

Figure 1:
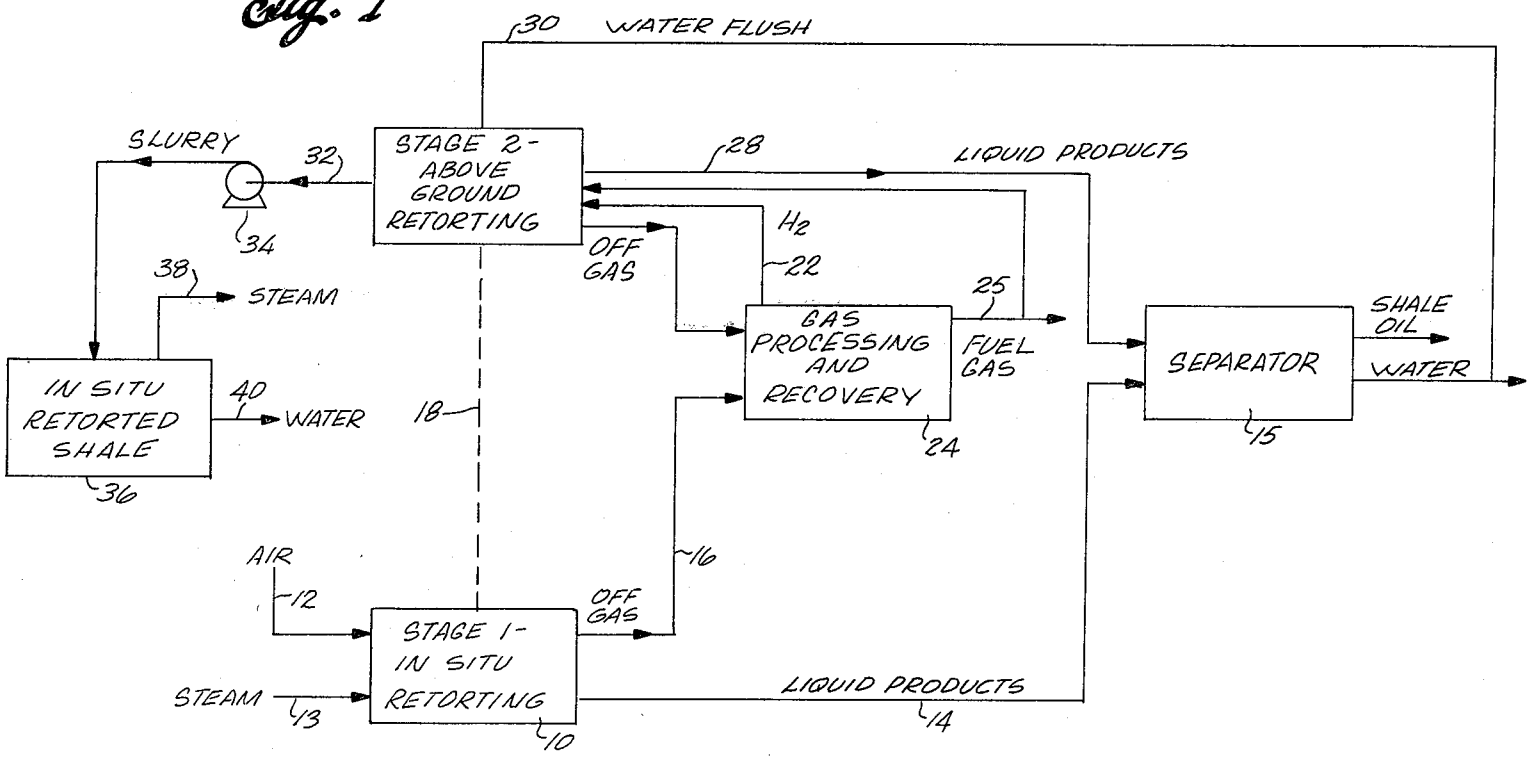
FIG. 1 is a schematic block diagram illustrating a two-stage retorting and spent shale disposal process according to principles of this invention.

Referring to the schematic block diagram of FIG. 1, which illustrates one embodiment of a process according to principles of this invention, a first stage operation 10 of a two-stage retorting process involves in situ oil shale retorting, such as described in the patents referred to above and incorporated herein by reference. According to the in situ retorting techniques generally described in those patents, a portion of a subterranean formation containing oil shale is excavated by conventional mining techniques to form at least one void within the boundaries of an in situ oil shale retort site, leaving a remaining zone of unfragmented formation within the boundaries of the retort site adjacent such a void. Such a remaining zone of formation is explosively expanded toward such a void to form a fragmented permeable mass of formation particles containing oil shale within the boundaries of the in situ retort site. Such a fragmented mass is referred to herein as an in situ oil shale retort, and such a fragmented mass is illustrated schematically at 42 and 142 in FIGS. 2 and 3, respectively.

The portion of formation mined from within the boundaries of the in situ retort site is in the range from about 15% to about 30% of the volume of formation within the in situ oil shale retort being formed. Thus, the fragmented mass has a void fraction from about 15% to about 30%. The fragmented mass in the in situ retort comprises formation particles containing oil shale having interstices between the particles. When the remaining zone of unfragmented formation is explosively expanded toward such a void, it expands into such a void so as to substantially fill the void left by removal of mined out portions of formation. The void space or spaces originally present within the retort site prior to explosive expansion becomes interspersed throughout the fragmented mass of particles in the retort being formed.

During first stage retorting operations, hot retorting gases pass through the fragmented mass in the in situ oil shale retort to convert kerogen contained in the fragmented mass of particles to liquid and gaseous products, leaving a spent in situ retort containing a mass of in situ retorted oil shale particles. Techniques for supplying hot retorting gases used for converting kerogen in the oil shale to shale oil are described in the patents referred to above. These techniques include establishing a combustion zone in the fragmented mass and introducing an oxygen supplying gaseous feed mixture, such as air 12 and steam 13, into the combustion zone to advance the combustion zone downwardly through the fragmented mass in the retort. For example, following explosive expansion of the shale, communication can be established with the top of the fragmented mass by drilling at least one and preferably a plurality of inlet passages into the top of the fragmented mass. Such inlet passages are illustrated at 44 and 144 in FIGS. 2 and 3, respectively. The gaseous feed mixture can be fed to the fragmented mass under pump pressure such as from a compressor located above ground or in a void space excavated at an upper working level above the in situ retort. In the combustion zone, oxygen in the gaseous feed mixture is depleted by reaction with hot carbonaceous materials to produce heat and combustion gas. By the continued introduction of the oxygen supplying gaseous feed mixture into the combustion zone, the combustion zone is advanced downwardly through the retort. The effluent gas from the combustion zone comprises combustion gas and the portion of the gaseous feed mixture that does not take part in the combustion process. The effluent gas passes through the fragmented mass in the retort on the advancing side of the combustion zone to heat the oil shale in a retorting zone to a temperature sufficient to produce kerogen decomposition, or retorting. This forms liquid and gaseous products and a residue product of solid carbonaceous material comprising mainly carbon, which burns in the presence of oxygen in the combustion zone.

The liquid and gaseous products are cooled by the cooler oil shale particles in the retort on the advancing side of the retorting zone. A liquid product stream 14 comprising the liquid carbonaceous products, or shale oil, together with water from the retort, is collected at the bottom of the retort and withdrawn to ground level through an access drift or shaft. Water can be separated from the shale oil in a separator 15 according to conventional separation techniques, such as gravity settling in a settling basin, or use of a heater-treater. An off gas 16 containing combustion gas generated in the combustion zone, product gas produced in the retorting zone, including hydrocarbons and hydrogen, and the portion of gaseous feed mixture that does not take part in the combustion process is also collected at the bottom of the retort and withdrawn to ground level. The retorted oil shale in the in situ retort is referred to as "spent oil shale", or "a fragmented mass of spent in situ oil shale particles", and the retorted in situ retort itself is referred to as a "spent in situ retort".

Following retorting, a lower portion of the spent in situ retort, which can occupy about one-third to one-fourth of the total volume of the fragmented mass, contains hot retorted oil shale at a temperature from about 1000° F. to 1400° F. The hot lower portion of the retorted oil shale in the in situ retort is illustrated at 46 in FIG. 2. The temperature of the retorted shale in the spent in situ retort decreases in a direction extending upwardly into higher elevations of the retort away from the hot lower portion of the fragmented mass. Retorted oil shale near the upper portion of the fragmented mass generally has a temperature below the boiling point of water, and commonly about 100° to 150° F.

The mined portion 18 of formation excavated for forming the void within the in situ retort site can be utilized in a second stage 20 of the process for separately retorting oil shale in the mined portion. This second stage can use an above ground retorting process for recovering liquid and gaseous products. For example, the second stage can utilize a hydrotorting process such as described in U.S. Pat. Nos. 3,617,469 or 3,617,472. According to these patents, particulate mined formation is processed in a metal retort under pressure in the presence of a hydrogen enriched atmosphere. At least part of the hydrogen 22 for hydrotorting can be derived from the first stage by processing the off gas produced by the first stage in situ retorting of oil shale. The off gas from the first stage of retorting can contain nitrogen, carbon dioxide, carbon monoxide, hydrogen sulfide, water vapor, and hydrocarbons such as methane and ethane. The off gas 16 can be passed through a gas processing recovery operation 24. This operation can comprise several different methods for treating the off gas which, in one embodiment, comprises recovery of hydrogen from the off gas for further use in hydrotorting. For example, the gas processing recovery operation can include purification of a fuel gas 25 and the cryogenic separation of hydrogen from the other gases present in the off gas, as well as formation of hydrogen from the water-gas shift reaction between carbon monoxide and water. The water-gas shift reaction can be catalyzed. The fuel gas 25 can be utilized as an energy source for retorting in the second stage 20. In another embodiment, hydrogen sulfide and carbon dioxide can be absorbed from the off gas by use of zeolites, diethanolamine, or other gas adsorbents. The hydrogen then can be separated from the remaining gas by use of zeolites or molecular sieve techniques, for example.

Other surface retorting processes known to those skilled in the art can be used in the second stage retorting step. Another suitable process in the TOSCO process similar to that described in U.S. Pat. No. 3,025,223. According to that patent, oil shale is crushed to a particle size of less than ½-inch and then retorted or stripped in a horizontal rotating kiln by heat transferred from solid heat transmitting ceramic balls. The retorted oil shale is combusted in a second horizontal rotating kiln for heating the ceramic balls. Separately retorting oil shale in the second stage 20 produces off gas 26 and liquid products 28 including shale oil and water. Water can be separated from the shale oil in the separator 15. Retorting of oil shale in the second stage 20 also produces a mass of spent surface retorted oil shale particles. These spent oil shale particles are disposed of by backfilling them into the open spaces or interstices between the in situ retorted oil shale particles in a spent in situ oil shale retort.

Retorting oil shale in the presence of hydrogen can produce high shale oil yield and at the same time reduce the oil shale to a powdery consistency, i.e., the oil shale can have a particle size of about 100 to about 200 mesh. This enables the formation particles retorted above ground in the second stage 20 of the surface retorting process to be mixed with water to form a slurry, as by flushing the surface retort after the surface retorting process is completed.

Such a slurry can be used to dispose of the spent oil shale particles remaining from the surface retorting process. The slurry can be used to feed the spent surface retorted particles into the interstices between the in situ retorted oil shale particles in a spent in situ oil shale retort. As illustrated in FIG. 1, preferably at least a portion of the water used for forming the slurry is water derived from in situ retorting of oil shale below ground in the first stage 10 retorting process and/or water derived from retorting oil shale in the second stage 20 retorting process.

The slurry 32 of formation particles containing surface retorted oil shale is then returned by pumping means 34 into a subterranean fragmented permeable mass of formation particles containing oil shale in an in situ oil shale retort after the first stage of retorting is completed, as indicated at 36. Suspension aids, such as those used in the drilling industry can be added to the slurry. This slurry, having particles of relatively smaller average particle size than the average particle size of the particles in the spent in situ retort, fills the interstices between the in situ retorted oil shale particles. When hydrotorting is used in the second stage retorting process, the mined portion of the formation particles is rendered very fine in particle size. Thus, the slurry can readily enter the interstices in the fragmented permeable mass of in situ retorted oil shale particles in the spent in situ retort.

Since the first stage operation 10 is a batch operation, the slurry from the second stage 20 is not necessarily returned to the same location from which the mined formation 18 is derived for the second stage operation. Instead, the slurry can be introduced into another spent in situ retort containing a fragmented permeable mass of in situ retorted oil shale particles.

Figure 2:
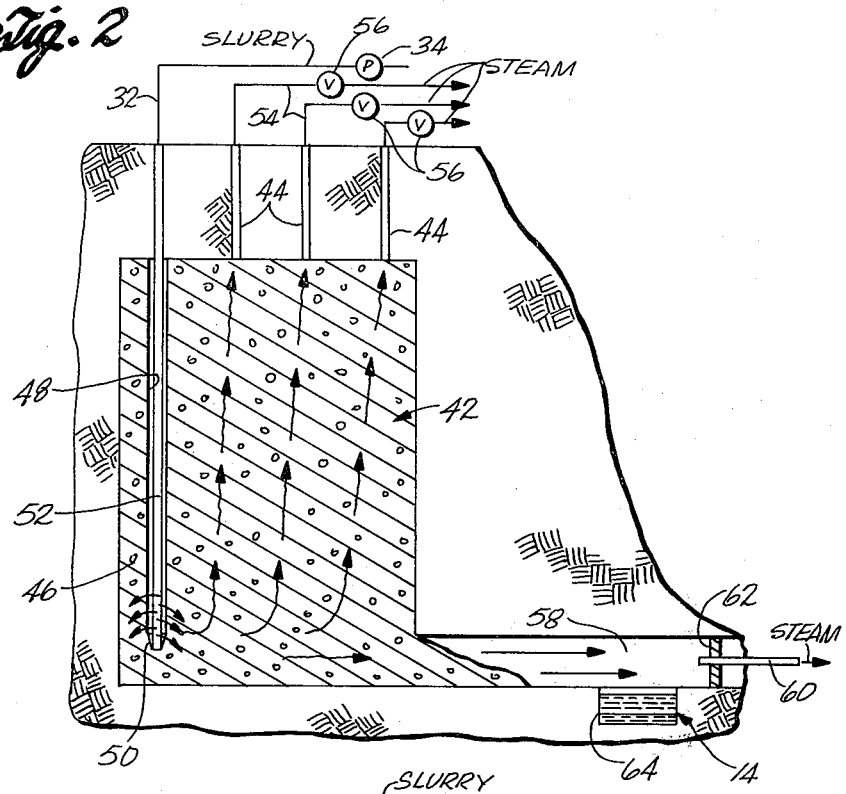
FIG. 2 is a semi-schematic vertical cross-sectional view illustrating one embodiment in which steam is recovered from a spent in situ oil shale retort.

FIG. 2 illustrates one practice of the invention in which the slurry of spent oil shale particles is returned to a spent in situ oil shale retort which still contains hot retorted oil shale particles from previous retorting operations. In this embodiment, the slurry is introduced directly into the hot lower portion 46 of the fragmented mass of in situ retorted oil shale particles. A drill hole 48 is bored downwardly into the in situ retorted oil shale particles by a drill bit 50 carried on the lower end of an elongated pipe 52. Although one drill pipe is shown in FIG. 2, in practice a plurality of such drill pipes are installed in the spent in situ retort. The pipe is first lowered through a previously formed inlet passage 44 that opens into the upper portion of the fragmented mass prior to drilling the drill hole 48. The pipe can comprise a number of pipe sections for being releasably secured together either at ground level, or in an upper level void or base of operation above the in situ retort. The pipe can be rotated about its axis for drilling the drill hole downwardly into the spent in situ retort. The top portion of the pipe can be connected to a rotary table (not shown) located above ground or in the upper base of operation. Cooling fluid can be introduced through the drill pipe for drilling through hot portions of the fragmented mass. The drill hole is drilled downwardly to near the bottom of the spent in situ retort, preferably into or above a region of hot retorted formation particles in the highest temperature zone in the fragmented mass. Temperatures in this region are often in the neighborhood of 1200° F. to about 1400° F., i.e., substantially above the boiling point of water; and temperatures can range from approximately 800° F. to 1200° F. at elevations in the fragmented mass above the hottest point. The drill pipe is left in place in the drill hole, forming a tubular conduit through which the slurry can be fed into the hot lower portion of the fragmented mass. The lower wall portion of the drill pipe adjacent the drill bit is perforated while the rest of the drill pipe outer wall is imperforate, so that the principal portion of the slurry being fed down through the drill pipe under pump pressure is forced outwardly through the lower perforations and into direct contact with the hot lower portion of the fragmented mass. The heat from the hot spent oil shale particles is transferred to the water contained in the slurry, causing the water to flash into steam. The steam generated within the hot portion of the fragmented mass preferentially flows upwardly through the void spaces between the spent oil shale particles in the retort above the point of injection of the slurry, as represented by the arrows in FIG. 2. The steam generated in the spent in situ retort can be exhausted from the retort through the passages 44 leading into the upper portion of the retort. These passages can include separate casings or outlet lines communicating with the passages and separate valves 56 for independently controlling flow of steam out through each outlet line. Steam generated in the hot portion of the spent in situ retort also can flow in a generally horizontal direction across the lower region of the fragmented mass toward a production level drift 58 in fluid communication with the lower production level of the spent in situ retort. In the illustrated embodiment, the production level drift 58 communicates with the lower portion of the fragmented mass through a side boundary of the retort. The steam passes into the production level drift and can be withdrawn from the drift through an outlet line 60 sealed through a bulkhead 62 installed in the drift. The production level drift also includes a sump 64 in which liquid products of retorting 14, namely, shale oil and water, are collected prior to being withdrawn and fed to the separator 15.

The steam generated in the spent in situ retort upon disposal of the aqueous slurry in the retort represents a source of recovered energy that can be in usable form. The steam, for example, can be used as an inlet feed mixture for retorting operations in other oil shale retorts, either surface retorts or in situ retorts. As another example, the steam can be used to run turbines or other steam powered equipment that can be used in other oil shale mining or processing operations. Removal of water from the slurry also serves to consolidate the solid particles and produce a denser packing of particles in the interstices than if water were not removed from the slurry.

In feeding the slurry into the spent in situ retort, it is preferred that the lower portion of the pipe 48 be spaced sufficiently far above the bottom boundary of the retort so the solid particles contained in the slurry fill the interstices in at least a portion of the spent oil shale particles contained in the retort below the bottom of the pipe. In fact, a region of spent shale in the lowermost portion of the spent in situ retort contains some retorted oil shale and possibly some unretorted shale at appreciably lower temperatures than the hot zone of retorted oil shale above it. That is, retorting operations are commonly terminated before the flame front reaches the bottom of the retort so as to reduce the temperature of the liquid and gaseous products withdrawn from the retort. This leaves a zone of cooler shale at the bottom of the retort. The water from the slurry is thus contacted by the hot shale particles at levels within the retort spaced above the bottom of the retort, and the solid particulate material in the slurry settles under gravity and fills the interstices between the spent shale particles in the cooler bottom region of the retort below the bottom of the pipe.

It is desirable to install such drill pipes at locations spaced apart generally uniformly across the horizontal cross section of the retort site so as to maximize the amount of contact between the water and the hot spent oil shale fragments across the horizontal cross section of the spent in situ retort. This maximizes the amount of steam generated in the retort as well as maximizing the amount of solid particles that can be disposed of while steam is being generated in the retort.

Figure 3:
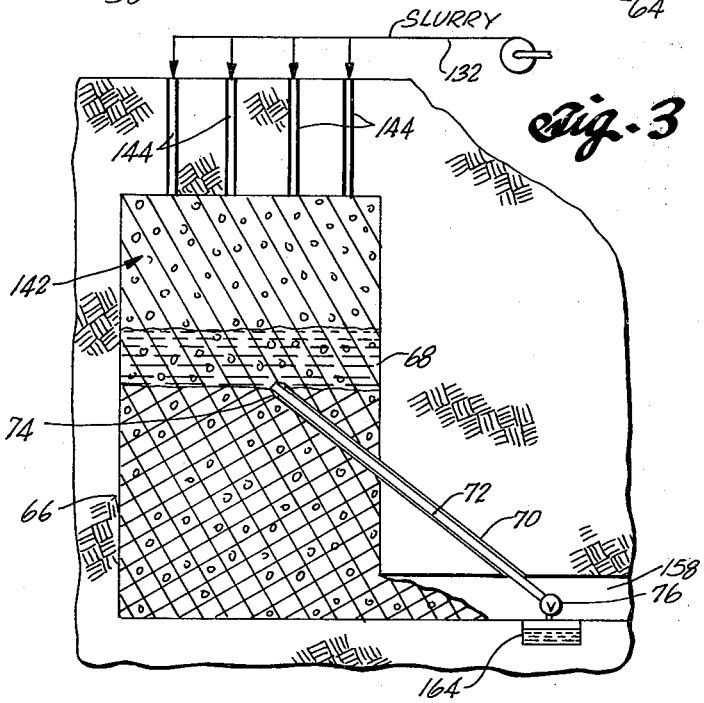
FIG. 3 is a semi-schematic vertical cross-sectional view showing another embodiment in which water is recovered from a spent in situ oil shale retort.

FIG. 3 illustrates an alternative practice for returning the aqueous slurry to a spent in situ oil shale retort. In this embodiment, an aqueous slurry 132 of spent oil shale particles is pumped into a spent in situ retort 142 through inlet passages 144 that open into the upper portion of the spent in situ retort. In this case, the spent in situ retort need not be a recently fired retort, but can be a burned out retort in which spent oil shale particles are at a reasonably uniform of steady state temperature, which can be less than 100° F. to 150° F., for example. The slurry enters the interstices between the in situ retorted oil shale particles in the spent in situ retort. A described above, the solid particulate matter contained in the slurry can include much smaller sized particles than the particle size of the retorted oil shale particles in the retort. Thus, continued pumping of the slurry into the spent in situ retort can result in the solid particulate matter in the slurry settling to the bottom of the retort and filling the interstices in the lower region of the retort with a dense volume of mud 66 principally in the form of fine spent oil shale particles. Water contained in the slurry can collect as a pool 68 in the spent in situ retort above the level of the dense mass of mud 66 in the lower portion of the retort. The water fills the interstices in the spent in situ oil shale particles above the mud. The water collected in the retort can be recovered by drilling a drill hole 70 diagonally upwardly from a lower production level drift 158 through unfragmented formation adjacent the retort and into the spent shale of the retort to the level of the retort where the water has collected or will collect. The drill hole can be drilled either before or after the water has collected. The drill hole can be drilled by one or more drill pipes 72 each having a drill bit 74 at its upper end. The annulus between the drill hole and the exterior of the drill pipe can be sealed to prevent any uncontrolled leakage of water into the lower drift. The drill pipe is left in place in the drill hole. After such a pipe is installed it can provide a passageway for draining the water from the pool in the retort into the lower production level drift. The water recovered from the retort can be collected in a sump 164 in the lower level drift. A valve 76 can be installed in the pipe for controlling drainage of water from the retort into the sump.

Thus, the water from the slurry can be recovered and put to further beneficial uses, such as in other retorting operations, or for reuse in an aqueous slurry for disposing of further spent oil shale particles.

The above described two-stage process has an advantage that mined formation containing oil shale which otherwise would be discarded from the in situ process is utilized to substantially increase the shale oil yield. In addition, the two-stage process produces minimal environmental impact by leaving part of the solid waste below ground. Furthermore, the water for forming the slurry can be product water recovered from the two-stage process, thereby providing a self-sufficient process needing no external source of water. Since water is a valuable commodity in Western portions of the United States where the bulk of U.S. oil shale deposits are located, this is an important advantage. Further, hydrogen obtained from the off gas 16 generated by the in situ retorting of oil shale can be utilized for hydrotorting. Moreover, steam can be generated when disposing of the solid wastes and recovered in usable form, and the water used in the slurry for backfilling the in situ retort can be recovered in reusable form.

What is claimed is:

1. A method for recovering shale oil from a subterranean formation containing oil shale and for disposing of spent shale from surface retorting, comprising the steps of:

forming an in situ oil shale retort containing a fragmented permeable mass of formation particles containing oil shale;

retorting oil shale particles in the fragmented mass for producing liquid and gaseous products of retorting and a spent in situ retort containing a mass of hot in situ retorted oil shale particles having a temperature sufficient to produce steam upon contact with water;

surface retorting a mass of formation particles containing oil shale for producing liquid and gaseous products of retorting and a mass of spent surface retorted formation particles;

drilling through the spent in situ retorted oil shale particles with a drill bit carried on each of a plurality of elongated conduits for installing the conduits at a plurality of locations spaced apart across the horizontal cross section of the spent in situ oil shale retort and in fluid communication with the hot in situ retorted oil shale particles;

introducing a slurry containing water and the surface retorted spent oil shale particles into the spent in situ oil shale retort through the conduits principally to the hot in situ retorted oil shale particles for contacting at least said hot in situ retorted oil shale particles with the water in said slurry for generating steam in the spent in situ oil shale retort; and withdrawing steam from the spent in situ retort through one or more outlet lines that open into a portion of the spent in situ retort containing such generated steam.

2. A method for recovering shale oil from a subterranean formation containing oil shale and for disposing of spent shale, comprising the steps of:

excavating a portion of the subterranean formation from within the boundaries of an in situ oil shale retort site for forming at least one void within the boundaries of the in situ oil shale retort site, leaving a remaining portion of formation within the retort site adjacent such a void;

excavating a lower level drift adjacent a lower boundary of the in situ retort site;

explosively expanding the remaining portion of formation toward such a void for forming an in situ oil shale retort containing a fragmented permeable mass of formation particles containing oil shale;

retorting oil shale in the in situ oil shale retort for producing liquid and gaseous products of retorting and a spent in situ retort containing a mass of in situ retorted oil shale particles;

separately retorting formation particles obtained from forming such a void in such an in situ oil shale retort for forming liquid and gaseous products of retorting and spent separately retorted oil shale particles;

drilling a passageway upwardly from the lower level drift through a portion of unfragmented formation into the spent in situ retort using a drill bit carried on a conduit;

forming an aqueous slurry of the spent separately retorted oil shale particles;

introducing the aqueous slurry into the spent in situ oil shale retort, causing water from the slurry to collect at a level within the spent in situ retort above at least a portion of the spent particles from the slurry introduced into the spent in situ retort;

draining the collected water from the spent in situ oil shale retort into the lower level drift through said conduit;

controlling flow of water into the lower level drift via a valve installed in the conduit in the drift; and withdrawing the water from the lower level drift.

3. A method for recovering shale oil from a subterranean formation containing oil shale and for disposing of spent shale from surface retorting, comprising the steps of:

forming an in situ oil shale retort containing a fragmented permeable mass of formation particles containing oil shale;

retorting oil shale particles in the fragmented mass for producing liquid and gaseous products of retorting and a spent in situ retort containing a mass of spent in situ retorted oil shale particles;

surface retorting a mass of formation particles containing oil shale for producing liquid and gaseous products of retorting and a mass of spent surface retorted oil shale particles;

introducing a slurry containing water and the surface retorted spent oil shale particles into the spent in situ oil shale retort for disposing of the surface retorted oil shale particles, causing a volume of water to collect within the spent in situ retort above at least a portion of the disposed surface retorted particles;

drilling at least one passageway with a drill bit on a conduit upwardly into the spent in situ retort from a point of recovery spaced from the spent in situ retort;

leaving such a conduit in place in the spent in situ retort for draining the collected water;

draining the water collected within the spent in situ retort through such a conduit to such a point of recovery; and controlling the flow of water through such a conduit via a valve installed in such a conduit.

4. The method according to claim 3 including drilling such passageway diagonally upwardly through unfragmented formation and into the spent retort from a lower level drift adjacent a lower boundary of the spent in situ retort.

5. A process for recovering liquid products from a subterranean formation containing oil shale, comprising the steps of:

excavating a portion of the subterranean formation from within the boundaries of an in situ oil shale retort site for forming at least one void within the boundaries of the in situ retort site, leaving a remaining portion of formation within the boundaries of the in situ retort site adjacent such a void;

explosively expanding the remaining portion of formation toward such a void for forming an in situ oil shale retort containing a fragmented permeable mass of formation particles containing oil shale, with interstices between the oil shale particles in the fragmented mass;

retorting oil shale in the in situ retort to produce liquid and gaseous products and a spent in situ retort containing a mass of in situ retorted oil shale particles having interstices between them, said mass of in situ retorted particles including a first portion of the spent in situ retort containing in situ retorted particles having a higher temperature than in situ retorted particles in a second portion of the spent in situ retort;

separately retorting oil shale excavated for forming an in situ oil shale retort, the excavated oil shale being in particle form when retorted, for producing liquid and gaseous products and separately retorted oil shale particles;

forming an aqueous slurry from the separately retorted oil shale particles, at least a portion of said separately retorted particles having a particle size such that they can enter the interstices in the mass of in situ retorted oil shale particles in the spent in situ oil shale retort;

drilling a passage through at least part of the first portion of the spent in situ oil shale retort with a drill bit carried on a conduit for installing such a conduit in the spent in situ retort, said first portion containing a mass of hot in situ retorted oil shale particles having a temperature sufficient to generate steam upon contact with water;

passing at least a portion of the aqueous slurry through such a conduit in the passage and having its principal outlet opening in the first portion of the spent in situ oil shale retort for filling the interstices in the mass of in situ retorted oil shale particles and for transferring heat to the aqueous slurry from such in situ retorted oil shale particles in such first portion for generating steam from the slurry introduced into the spent in situ oil shale retort.

6. The method according to claim 5 including withdrawing steam from the spent in situ retort through at least one outlet communicating with an upper portion of the spent in situ retort.

7. The method according to claim 5 including withdrawing steam from a drift communicating with a lower portion of the spent in situ oil shale retort.

* * * * *